US008591096B2

(12) United States Patent
Bongratz

(10) Patent No.: US 8,591,096 B2
(45) Date of Patent: Nov. 26, 2013

(54) VARIABLE HEIGHT BLENDER SYSTEM

(75) Inventor: Howard Bongratz, Gurnee, IL (US)

(73) Assignee: Eirich Machines, Inc., Gurnee, IL (US)

( * ) Notice: Subject to any disclaimer, the term of this patent is extended or adjusted under 35 U.S.C. 154(b) by 859 days.

(21) Appl. No.: 12/784,705

(22) Filed: May 21, 2010

(65) Prior Publication Data

US 2011/0286299 A1 Nov. 24, 2011

(51) Int. Cl.
*B01F 7/04* (2006.01)

(52) U.S. Cl.
USPC ..... 366/142; 366/192; 366/194; 366/331

(58) Field of Classification Search
USPC ..... 366/142, 192, 194, 331
See application file for complete search history.

(56) References Cited

U.S. PATENT DOCUMENTS

| | | | |
|---|---|---|---|
| 689,170 | A | 12/1901 | Dragoo et al. |
| 968,739 | A | 8/1910 | Carlson |
| 1,065,607 | A | 6/1913 | Hennessy |
| 1,324,960 | A | 12/1919 | Gasteiger |
| 1,332,063 | A | 2/1920 | Powers |
| 1,533,950 | A | 4/1925 | Schlich |
| 1,943,194 | A | 1/1934 | Vachoux |
| 2,387,024 | A | 10/1945 | Hishon et al. |
| 2,416,748 | A | 3/1947 | Gnoerk |
| 2,739,804 | A | 3/1956 | Funderburk, Jr. |
| 3,145,976 | A | 8/1964 | August et al. |
| 4,006,260 | A | 2/1977 | Webb et al. |
| 4,525,070 | A | 6/1985 | Gressette, Jr. |
| 5,090,815 | A | 2/1992 | Bohle |
| 5,474,379 | A | 12/1995 | Perry |
| 5,853,015 | A | 12/1998 | Evans |
| 7,121,715 | B1 | 10/2006 | Bongratz |
| 2008/0107931 | A1 | 5/2008 | Han et al. |
| 2008/0316856 | A1 * | 12/2008 | Cooley et al. ..... 366/142 |
| 2009/0103392 | A1 | 4/2009 | Bilger |

OTHER PUBLICATIONS

International Search Report and Written Opinion, International Application No. PCT//US2011/035605 dated Aug. 9, 2011.
International Preliminary Report on Patentability, International Application No. PCT/US2011/035605, dated Dec. 6, 2012.

* cited by examiner

*Primary Examiner* — David Sorkin
(74) *Attorney, Agent, or Firm* — McCracken & Frank LLC

(57) ABSTRACT

A variable height blender system is disclosed that includes an industrial blender carried by a first lift and a second lift for moving the blender up and down into any of various vertical positions. The variable height blender system includes drive controls for independently controlling movement of the first and second lifts, and a synchronizer in communication with at least one of the first and second drive controls for synchronizing the movement of the first and second lifts to maintain the batch blender substantially level. The synchronizer includes a level sensor that senses a tilt of the batch blender with respect to a local gravity vector and sends level reading signals to the synchronizer for use in independently adjusting the speeds of the first and/or second lift.

20 Claims, 3 Drawing Sheets

VARIABLE HEIGHT BLENDER SYSTEM

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates to a blender system that can be adjusted to a plurality of heights.

2. Description of the Background of the Invention

A variable height blender, such as used in industrial applications for example, is known to be useful in order to facilitate easier loading and unloading of mix contents from the blender. In a batch blender, a blender is loaded with a specific amount, or batch, of contents that are to be mixed, the contents are mixed without any contents being added or subtracted from the blender, and when mixing is complete, the contents are removed from the blender. Often, it is desirable to be able to load the contents with the blender at approximately floor level, such as by shoveling contents into the blender by hand, and to be able to unload the contents of the blender into a container that is also at approximately floor level. In order to facilitate easier unloading of the contents, different systems have been developed to raise the blender above floor level so that the contents can be emptied from the blender by gravity into the container at ground level.

In one example, Bohle U.S. Pat. No. 5,090,815 discloses a batch mixer that is carried between two mechanisms for vertically moving the batch mixer up and down between an upper position and a lower position. The moving mechanisms are disclosed as being two vertically oriented fluid cylinder and piston units, such as hydraulic cylinders or pneumatic cylinders, and guides. The cylinder and piston units are designed to positively move the vessel upwardly. The batch mixer has a openable top cover and a discharge outlet in a bottom thereof. In use, the batch mixer is loaded through the open top when the batch mixer is in a lowered position and emptied by gravity through the discharge outlet when the batch mixer is in a raised position. However, Bohle does not provide specific information regarding how the two fluid cylinders are controlled.

In another example, Bongratz U.S. Pat. No. 7,121,715 discloses a batch blender that is carried between two vertically oriented hydraulic lifts such that the hydraulic lifts can move the batch blender up and down to provide easy top loading at floor level and easy gravity discharge into a container placed below the batch blender after the batch blender has been raised. Bongratz '715 teaches that the hydraulic lifts are coordinated in a standard fashion to keep the horizontal axis of the batch blender substantially parallel to the floor in both a discharge position and a loading position. However, Bongratz '715 does not provide explicit detail about how the hydraulic lifts are coordinated.

The inventor of the present application has found that hydraulic lifts and the standard systems for coordinating such hydraulic lifts known previously tend to be complicated and/or can cause unintended and/or undesirable limitations on the vertical travel or stroke of the lifts and the batch blender. Therefore, the inventor has developed a new system that provides advantages over the previously known systems.

SUMMARY OF THE INVENTION

According to one aspect of the present invention, a variable height blender system includes a blender comprising a body carried by a first lift and a second lift, a first drive control for independently controlling movement of the first lift and a second drive control for independently controlling movement of the second lift. The first and second lifts lift the batch blender from a first height upwardly to a second height in response to commands received from the first and second drive controls. The variable height blender system also includes a synchronizer in communication with at least one of the first and second drive controls for synchronizing the movement of the first lift and the second lift to maintain the batch blender substantially level. The synchronizer comprises a level sensor that senses a tilt of the batch blender with respect to a local gravity vector.

According to another aspect of the present invention, a variable height blender system includes a blender supported by a lift that moves the blender between a plurality of different heights. The lift includes first and second independently driven actuators. The first actuator supports a first side of the blender and the second actuator supports a second side of the blender opposite the first side. An electronic synchronizer includes a level sensor carried by the blender and a logic circuit in communication with the level sensor. The synchronizer provides commands to the actuators to vary a speed of at least one of the actuators in order to maintain the blender in a level condition.

According to a further aspect of the present invention, a variable height blender system includes a blender carried by and between first and second lifts, wherein each lift is independently driven by a separate actuator including a variable speed motor, and an electronic synchronizer for maintaining the blender in a predefined level orientation while the lifts move the blender from a first height to a second height. The synchronizer includes a level sensor that determines a level reading in relation to a local gravity vector attached to the blender, a first circuit that reads a level reading of the level sensor, a second circuit that calculates which side of the blender is higher, a third circuit that senses a direction the lifts are moving, and a fourth circuit that adjusts a speed of at least one of the actuators in response to the calculation and the direction in order to return the blender to a level condition.

Other aspects and advantages of the present invention will become apparent upon consideration of the following detailed description.

DETAILED DESCRIPTION

Figure 1:
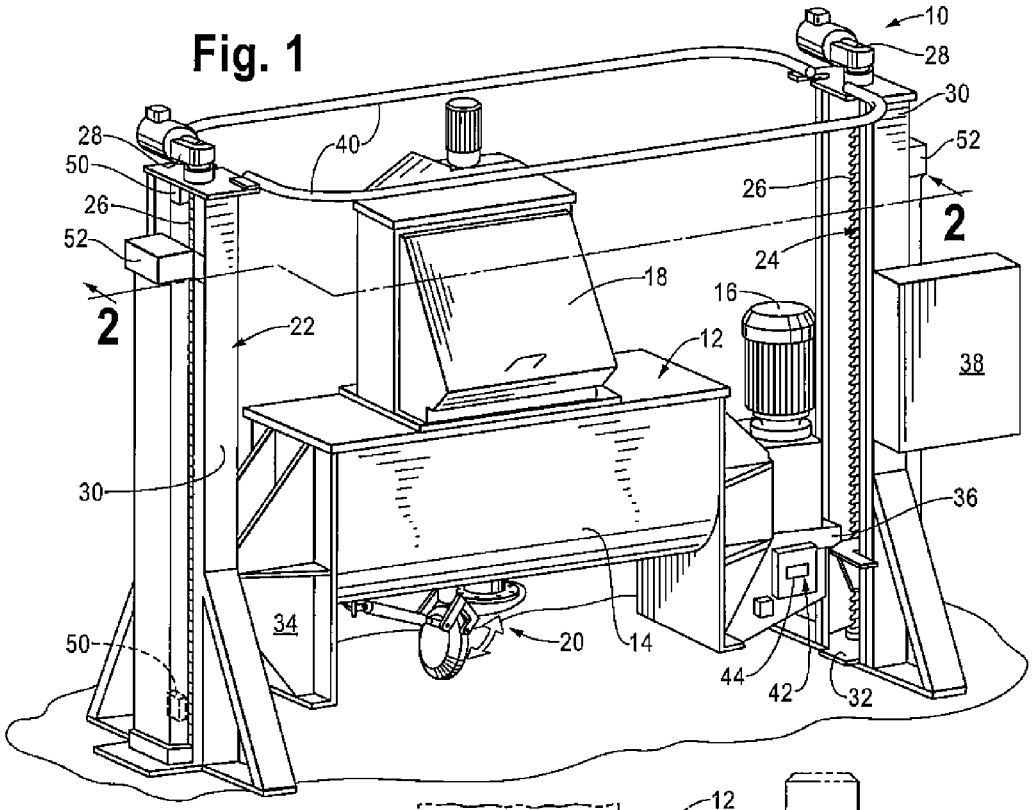
FIG. 1 is an isometric view of a variable height blender system of the invention.
Figure 2:
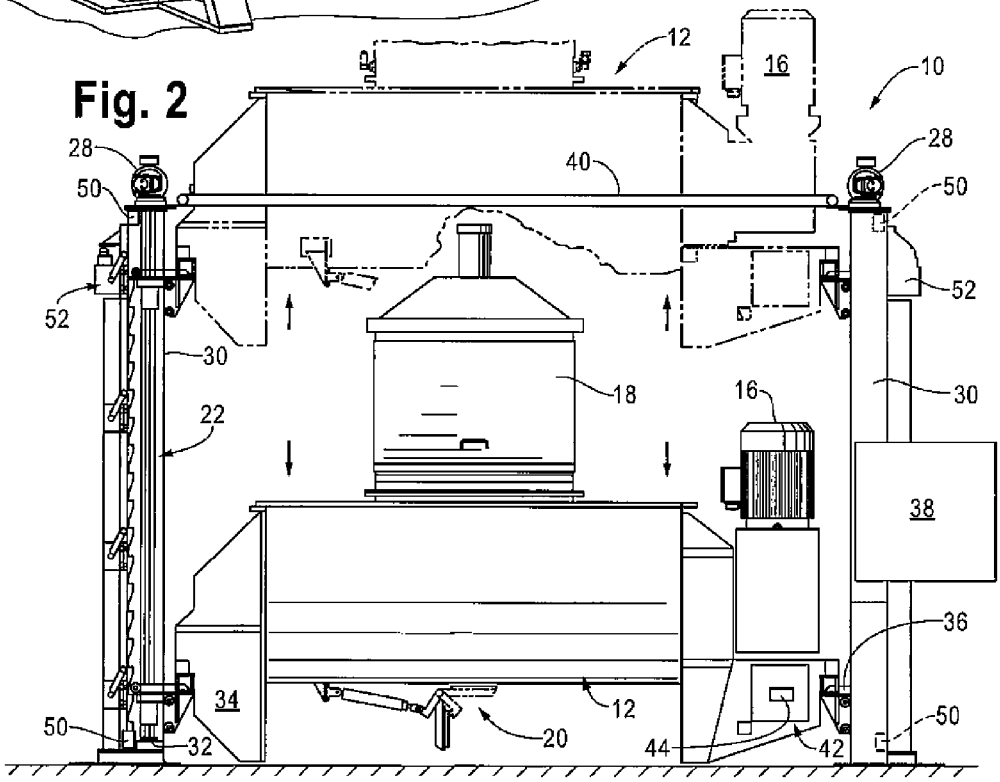
FIG. 2 is a front elevation view in partial cross section of the variable height blender system along the lines 2-2 of FIG. 1.

Turning now to the drawings, FIGS. 1 and 2 show a variable height blender system 10 including a blender 12 carried by lift system for varying the height of the blender in response to control command from an operator. The lift system moves the blender to any of a plurality of positions between a bottom or lowest position shown in full lines in FIG. 2 and a top or highest position as shown in phantom lines in FIG. 2. Preferably, the lift system is adapted to vary and maintain the height of the blender 12 in any of an infinite number of positions between the lowest position and the highest position.

In a preferred embodiment, the blender 12 includes a batch blender of the type usually used in industrial applications, such as for blending granular or pelletized product. The blender includes a body 14, a blending apparatus (not visible) therein and a motor 16 for driving the blending apparatus. One acceptable type of batch blender has an openable top loading port 18 and a closable bottom discharge port 20 having a valve mechanism as disclosed in Bongratz U.S. Pat. No. 7,121,715, which is incorporated by reference herein in its entirety. The discharge port 20 may optionally include a plug valve with an actuator as shown in the drawings, another type of valve mechanism. Other types of blenders may also be used, and the invention is not necessarily limited to a particular type of blender.

The lift system includes a first lift 22 and a second lift 24. Each lift 22, 24 has an independently driven linear drive mechanism. The drive mechanisms preferably can be positively driven in two opposite directions, such as up and down, although the drive mechanisms might alternatively be of a type that is positively driven upwardly and allowed to move downwardly under the force of gravity. In a preferred embodiment, each lift includes a ball screw 26 driven by a variable speed motor 28. The variable speed motors 28 may be brake motor with a gear drive, servo motors, or other type of variable speed motor as would be known in the art. Each ball screw 26 is oriented vertically and partly surrounded by a support column 30 that also provides a guiding mechanism for the ball screw 26. A bottom end of each ball screw 26 is seated in an axial thrust bearing 32 and a top end of the ball screw is linked to the motor 28 seated at the top of the support column 30. Other types of drive mechanisms may be used, including different types of motors and different types of actuators, as long as the speed of the drive mechanism can be independently controlled and preferably has a plurality of different drive speeds. Other types of linear actuators that can be independently driven may also be used, such as worm drives, cable drives, rack and pinion drives, piston drives, chain and pulley drives, independently pumped hydraulic or pneumatic drives, etc.

In the present example, the blender 12 is attached to the first lift 22 with a carriage bracket 34 and is attached to the second lift 24 with a second carriage bracket 36. The carriage brackets 34, 36 may be secured directly to the body 14 of the blender 12 as shown in the example, or may be part of a unitary carriage assembly that is separate from the blender 12 to which the blender 12 is subsequently attached or secured. Each carriage bracket 34, 36 is secured to a respective one of the ball screw 26 with appropriate bearings so that the carriage brackets 34, 36 are moved up and down along the respective ball screws 26 in response to rotation of the ball screws 26 in any manner known to a person of skill in the art.

The lifts 22, 24 are preferably controlled by an electronic control system including a computerized programmable logic controller (hereinafter, "PLC") including a memory and embedded circuits carried in a panel 38 associated with the variable height blender system 10, interface switches (not shown) on the panel 38 for being actuating by an operator to cause the lifts 22, 24 to raise and/or lower the blender 12, and control and power wiring and/or programming suitable for controlling and powering the drive mechanism. In one arrangement, when a first switch is engaged, the drive motors 28 are activated to rotate the ball screws 26 in a first direction to raise the blender 12. Similarly, when a second switch is engaged, the drive motors 28 are activated to rotate the ball screws 26 in an opposite direction to lower the blender 12.

The motors 28 are powered in a leader-follower arrangement, but the motors 28 may be powered separately. In either arrangement, each motor 28 is capable of being driven or controlled independently of the other motor 28 so that the speed and/or operation of one motor 28 may be varied from the speed and/or operation of the other motor 28 for reasons explained herein below. Wire harnesses and conduits 40 for connecting the motors 28 to power and control signals are, in one embodiment, carried at the tops of the columns 30 and preferably provide an opening therebetween in order to provide space sufficient for the blender 12 to travel to the full heights of the ball screws 26 without interference.

The variable height blender system 10 also includes a synchronizer 42 for ensuring that actuation of the lifts 22, 24 is coordinated in such manner that the blender 12 remains substantially level with respect to the local gravity vector, (i.e., the direction of gravity at that locale) as the blender 12 is raised and lowered by the lifts 22, 24. The synchronizer 42 includes a level sensor 44 that senses the level of the blender 12 with respect to the local gravity vector and control circuitry for providing control commands to the motors 28 in order to independently adjust the speed and/or operation of one or both of the motors 28 to maintain the blender 12 level within a predefined limit. The synchronizer 42 may communicate with each motor 28 in any appropriate manner, such as either being wired directly to each motor 28 or being wired to an intermediate control mechanism such as the switches in the control panel 38 or wirelessly. In any circumstance, the synchronizer 42 is able to vary the speed and/or operation of one or both of the motors 28 such that the lifts 22, 24 are synchronized to maintain the blender 12 level.

In a preferred embodiment, the level sensor 44 includes as ratiometric electronic inclinometer that is secured in a fixed relation to the blender 12. An exemplary preferred level sensor 44 is a single axis tilt sensor available under the trade name SPECTROTILT™ ratiometric electronic inclinometer from Spectron Systems Technology, Inc., of Hauppauge, N.Y. The level sensor 44 mechanically senses a level plane in relation to the local gravity vector and provides an output signal that varies in proportion to the orientation of the level plane in a manner known in the art. Other devices for sensing the level of the blender 12 may be used so long as the level sensor 44 provides an electronic signal readable by an appropriately arranged circuit to sense at least some readings regarding the level of the blender 12, and the invention is not necessarily limited to any specific level sensor hereby. In a preferred arrangement, the level sensor 44 is secured directly to the carriage bracket 36; however, the level sensor 44 may be attached to the body 14 of the blender 12 or to a flange or any other fixed structure that is also secured to the body 14 of the blender 12 or has a fixed position and orientation in relation to the body 14 of the blender 12, such as by fasteners, in such manner that tilting movement of the body 14 is sensed by the level sensor 44. The level sensor 44 is affixed to and/or adjusted on the blender 12 in such manner and position that the level sensor 44 accurately senses the level orientation of the blender 12 when the variable height blender system 10 is installed and functional in any known manner.

Figure 3:
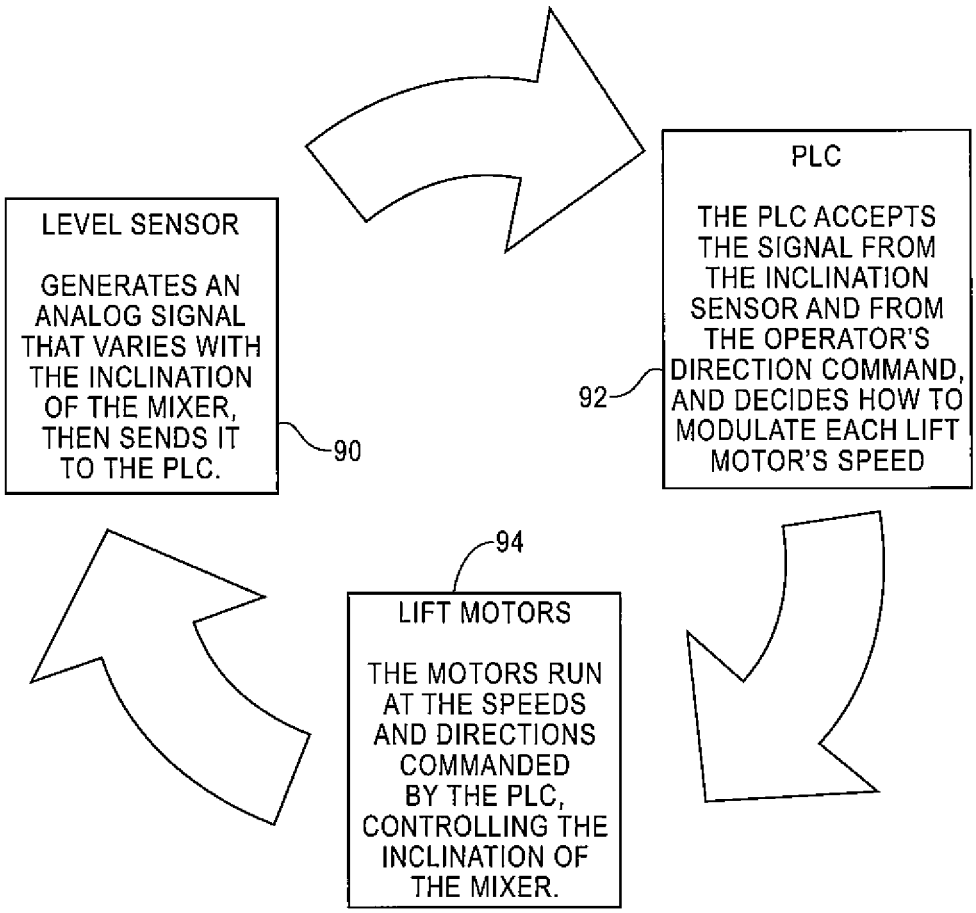
FIG. 3 is a command flow diagram of a synchronizer of the variable height blender system.

As shown in FIG. 3, the synchronizer 42 implements a repeating sequence of control steps to maintain the blender 12 at a predefined level orientation. At a step 90, the level sensor 44 generates a signal that indicates a current level orientation of the blender 12 and sends the signal to the PLC. Next at step 92, in response to the signal received from the level sensor 44, the PLC decides how to modulate the speed of each motor 28 in a manner calculated to return to and/or maintain the predefined level orientation and sends appropriate control commands to individually control the speeds of the motors 28. Thereafter at step 94, the motors 28 run at the speeds and in the direction commanded by the PLC. The sequence then returns to the step 90 and continues until interrupted.

Figure 4:
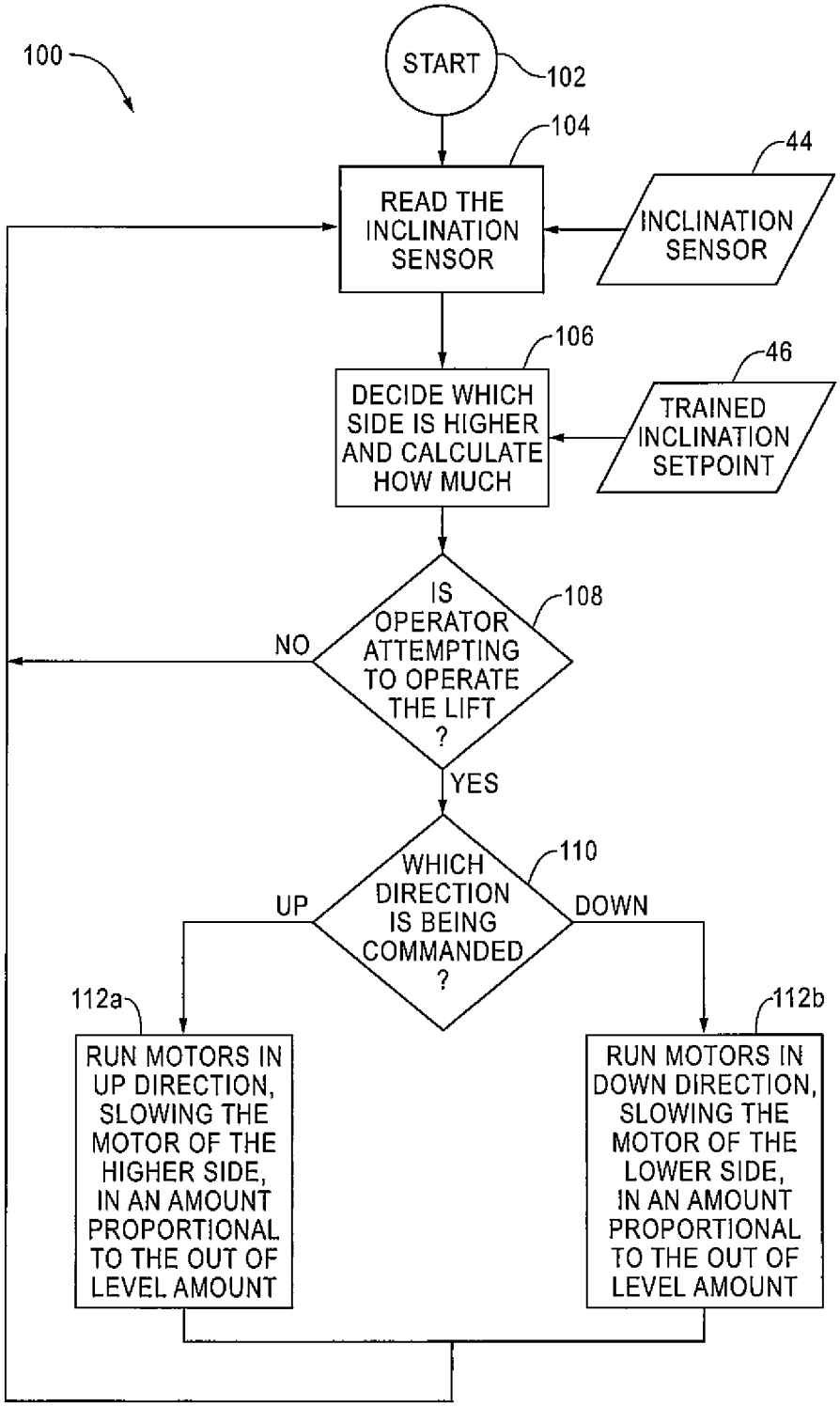
FIG. 4 is a logic flow diagram of steps performed by the synchronizer.

A synchronization routine 100 shown schematically in FIG. 4 includes a preferred series of logic steps for implementing the decision and command generation process of step 92 in FIG. 3. A block 102 initiates the synchronization routine 100. The block 102 may be initiated upon powering on the control panel 38 and associated control circuitry in any manner known in the art. Alternatively, the block 102 may be initiated after powering on the control panel 38 by the actuation of one of the switches on the control panel 38 and may initiate movement of the lifts 22, 24 to either raise or lower the blender 12 or at any other time convenient and suitable for running the synchronization routine 100.

After initiation of the synchronization routine 100, control passes to a block 104, which reads a signal from the level sensor 44 that indicates a level reading therefrom. The signal may be any signal that provides sufficient information to calculate a level orientation of the level sensor 44 in a manner as understood in the art and may be communicated in any manner and device sufficient to transmit the signal from the level sensor 44 to the block 104.

In response to the signal received from the level sensor 44, control passes to a block 106 that identifies which lift 22, 24 is higher and calculates the height difference. The block 106 compares the level reading from the level sensor 44 with a stored or accessed inclination set point from a database 46 or other memory storage medium. Based on the angular difference between the inclination set point and the level reading, the block 106 calculates the height difference, if any, between the two lifts 22, 24. The inclination set point is preferably a predefined level orientation in relation to a plane perpendicular to the local gravity vector, i.e., a level plane. The predefined level orientation may be identical with the level plane or may be tilted a predefined amount and orientation with respect to the level plane depending on the particular needs of any particular installation and/or calibration of the level sensor 44. The predefined level orientation may also include some predefined range of acceptable angular variation within a predefined angular range as desired. The inclination set point may be defined in any manner considered necessary for any given application and local condition, such as by calibration or training after installation of the variable height blender system 10 at a particular location, and is not necessarily limited to any particular numerical range. For purposes of this discussion, the "height" of a lift may refer to the relative height position of one side of the blender 12 in comparison to the position of the opposite side of the blender 12 in relation to a predefined level orientation, and optionally also in relation to a predefined range of motion of the entire blender 12 between an ultimate "top" position and an ultimate "bottom" position as would be apparent to a person of skill in the art. Thus, for example, if the carriage brackets 34, 36 are attached to the blender 12 at different absolute heights, the "height" of a lift may refer to some offset distance and/or angle from the predefined level orientation of the blender 12 necessary to maintain the blender 12 within the predefined level orientation, whereas if the carriage brackets 34, 36 are attached to the blender 12 at the same height, then the "height" of a lift may simply refer to the location of the carriage bracket on the ball screw 26. In a preferred embodiment, the "height" of a lift 22, 24 is coincident with or at a known offset from the location of the carriage bracket 34, 36 attached to the respective ball screw 26 in comparison to some predefined level orientation and/or range of travel on the ball screw 26. The height difference may be calculated in any standard mathematical way.

After the height difference is calculated, control passes to a block 108, which senses whether the lifts 22, 24 are being actuated. Preferably, the block 108 senses if any interface switch for actuating the lifts 22, 24 is in an "on" position. However, other equally suitable modes of sensing whether the lifts 22, 24 are being actuated may also be used as would be clear to a person of skill in the art. If the lifts 22, 24 are not being actuated, control passes back to block 104 and continues through the routine 100. If block 108 senses that the lifts 22, 24 are being actuated, control passes to block 110.

Block 110 senses what direction the lifts 22, 24 are being moved. For example, in the present embodiment, the block 110 senses whether the lifts 22, 24 are being moved"up" or "down" to respectively either raise or lower the blender 12. An exemplary method of sensing the direction is to sense which switch, either an "up" switch or a "down" switch is currently in an "on" state. Other equally suitable modes of sensing which direction the lifts 22, 24 are being moved may also be used as would be clear to a person of skill in the art.

After sensing what direction the lifts 22, 24 are being moved, the speed of the motor on the lift 22, 24 that is further advanced in the direction of movement of the lifts is slowed in an amount calculated to bring the blender 12 back to the predefined level orientation. Preferably the speed of the lift 22, 24 that is further advanced is slowed in an amount that is proportional to the amount the blender 12 is out of level. The amount of slowing may range from zero, corresponding to no slowing at all, to a non-zero amount corresponding to some determined amount of slowing. In the exemplary embodiment of FIG. 4, if the block 110 determines that the lifts 22, 24 are being commanded to move up, control passes to a block 112*a* which slows the motor of the higher of the two lifts 22, 24 in an amount proportional to how out of level the blender 12 is with respect to the inclination set point as calculated from the signal from the level sensor 44. Alternatively, if the block 110 determines that the lifts 22, 24 are being commanded to move down, control passes to a block 112*b*, which slows the motor of the lower of the two lifts 22, 24 in an amount proportional to how out of level the blender 12 is. The PLC preferably is set at a default to drive both motors 28 at the same speed unless one motor 28 is slowed as a result of the synchronization routine 100. Thus, for example, if the blender 12 is not out of level as defined by the inclination set point, then the amount of slowing would be zero, thereby causing both motors 28 to run at the same speed. However, if the blender 12 is out of level, then the amount of slowing of the more advanced lift 22 or 24 would be non-zero, thus causing the other lift 22 or 24 to catch up to bring the blender 12 back to level. In this manner, the synchronization routine 100 can advantageously eliminate an extra logical step of first determining whether the blender 12 is out of level at all by simply not changing the speed of either motor 28 under such circumstance.

After completion of block 112*a* or 112*b*, control preferably returns to block 104 and the sequence of blocks 104 through 112*a* or 112*b* is repeated. The sequence is repeated as desired, whether continuously or periodically, until the synchronizer 42 is powered off or otherwise stopped. In this manner, the sequence continues to repeat and continuously adjusts the speed of one or both of the motors 28 to maintain the blender 12 at the predefined level orientation as long as the lifts 22, 24 are being actuated.

The steps of the synchronization routine 100 may be implemented in any order that is sufficient to monitor and control the motors 28 in a manner that will return and/or maintain the blender 12 in the predefined level orientation and/or predefined margin of error.

The synchronization routine 100 of the synchronizer 42 is preferably implemented by hard-wired electrical circuits, sensors, and/or software controlled computer circuits in response to actuation commands provided by an operator. In a preferred embodiment, each of the blocks 102-112*b* is implemented by an electronic circuit that is part of a programmed computer, including an electronic memory, processing unit, and data communication links as necessary to communicate with the switches on the control panel 38, the motors 28, and the level sensor 44, all as would be apparent to a person of ordinary skill in the art. FIGS. 1 and 2 show a preferred embodiment, wherein the synchronizer 42 is embodied within electronic circuitry, memory units, and associated data and control connections with the level sensor 44 and integrated with the PLC unit carried on the panel 38. However, the synchronizer 42 is not necessarily limited to the exact implementation shown and described herein as long as the synchronizer 42 is able to control the level orientation of the blender 12 in the manner described herein.

Travel limit switches 50 are preferably disposed at opposite ends of one or both of the lifts 22, 24 to prevent the lifts 22, 24 from moving the blender 12 too far up or down. A preferred travel limit switch 50 includes a photo sensor, or so-called electric eye, disposed at locations near the top and bottom ends of the ball screws 26 such that the photo sensor will send a signal that stops actuation of the motors 28 when the blender 12 has reached a predefined position. Other types of travel limit switches, such as mechanical switches, electrical switches, etc., may alternatively or additionally be used.

A stop mechanism 52 is preferably included with one or both of the lifts 22, 24 in order to prevent the blender 12 from moving downwardly due to gravity at an inopportune time. A preferred stop mechanism 52 includes a mechanical locking mechanism that interacts with a column of teeth in a ratchet-type mechanism disposed in each column 30 and a pneumatic release for releasing the locking mechanisms from the teeth when the operator desires to move the blender down. Other stop mechanisms may also be used.

Industrial Applicability

The present invention is useful in industrial and other settings for raising and lowering a blender in a manner calculated to maintain the blender at or within a predefined level orientation.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the impending claims are reserved.

I claim:

1. A variable height blender system comprising:

a batch blender comprising a body carried by a first lift and a second lift;

a first drive control for independently controlling movement of the first lift and a second drive control for independently controlling movement of the second lift, wherein the first and second lifts lift the batch blender from a first height upwardly to a second height in response to commands received from the first and second drive controls; and a synchronizer in communication with at least one of the first and second drive controls for synchronizing the movement of the first lift and the second lift to maintain the batch blender substantially level, wherein the synchronizer comprises a level sensor that senses a tilt of the batch blender with respect to a local gravity vector.

2. The variable height blender system of claim 1, wherein each of the first and second lifts comprises a ball screw and an actuator for actuating the ball screw.

3. The variable height blender system of claim 2, wherein each of the actuators comprises a variable speed motor.

4. The variable height blender system of claim 3, wherein each of the variable speed motors comprises a brake motor.

5. The variable height blender system of claim 1, wherein the level sensor comprises an inclinometer carried by the blender.

6. The variable height blender system of claim 5, wherein the synchronizer further comprises a circuit adapted to send commands to at least one of the first and second drive controls in response to signals received from the level sensor.

7. The variable height blender system of claim 6, wherein the circuit transmits a command to the drive control to vary the speed of the lift associated therewith in order to maintain the blender substantially level in response to a signal received from the level sensor.

8. The variable height blender system of claim 7, wherein the first lift is spaced apart from the second lift and the blender is disposed between the first and second lifts.

9. The variable height blender system of claim 8, wherein the first lift comprises a first column, the second lift comprises a second column, and the first and second columns are independently secured to a support surface.

10. The variable height blender system of claim 9, wherein the blender travels the full height of the first and second columns.

11. The variable height blender system of claim 9, further comprising electric sensors in communication with the drive controls to prevent the batch blender from traveling beyond one or more preselected positions along the columns.

12. A variable height blender system comprising a blender supported by a lift that moves the blender between a plurality of different heights, the lift comprising first and second independently driven actuators, the first actuator supporting a first side of the blender and the second actuator supporting a second side of the blender opposite the first side, and an electronic synchronizer comprising a level sensor carried by the blender and a logic circuit in communication with the level sensor, wherein the synchronizer provides commands to the actuators to vary a speed at least one of the actuators in order to maintain the blender in a level condition.

13. The variable height blender system of claim 12, wherein each of the actuators comprises a ball screw driven by a variable speed brake motor.

14. The variable height blender system of claim 13, wherein each of the actuators comprises an upwardly projecting column, and the actuators lift the blender to a full height of the columns.

15. A variable height blender system comprising a blender carried by and between first and second lifts, wherein each lift is independently driven by a separate actuator including a variable speed motor, and an electronic synchronizer for maintaining the blender in a predefined level orientation while the lifts move the blender from a first height to a second height, the synchronizer comprising:

a level sensor attached to the blender, wherein the level sensor determines a level reading in relation to a local gravity vector;

a first circuit that reads the level reading;

a second circuit that calculates which side of the blender is higher;

a third circuit that senses a direction the lifts are moving; and a fourth circuit that adjusts a speed of at least one of the actuators in response to the calculation and the direction in order to return the blender to a level condition.

16. The variable height blender system of claim 15, wherein the fourth circuit adjusts the speed of the actuator in an amount proportional to the level reading.

17. The variable height blender system of claim 16, wherein the level sensor comprises an electronic inclinometer.

18. The variable height blender system of claim 17, wherein each actuator comprises a ball screw driven by a brake motor.

19. The variable height blender system of claim 18, further comprising a limit switch to stop the actuators when the blender has reached a preselected position.

20. The variable height blender system of claim 18, wherein the blender travels to a full height of the lifts.

* * * * *